US007031636B2

(12) United States Patent
Schultheis et al.

(10) Patent No.: US 7,031,636 B2
(45) Date of Patent: Apr. 18, 2006

(54) ELECTROPHOTOGRAPHIC PRINTING DEVICE OF MODULAR CONSTRUCTION

(75) Inventors: Bernd Schultheis, Schwabenheim (DE); Brigit Lattermann, Ried-Stadt (DE); Dieter Jung, Daaden (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 10/399,619

(22) PCT Filed: Oct. 6, 2001

(86) PCT No.: PCT/EP01/11539

§ 371 (c)(1),
(2), (4) Date: Oct. 20, 2003

(87) PCT Pub. No.: WO02/35293

PCT Pub. Date: May 2, 2002

(65) Prior Publication Data

US 2004/0047647 A1 Mar. 11, 2004

(30) Foreign Application Priority Data

Oct. 20, 2000 (DE) ..... 100 52 371

(51) Int. Cl.
*G03G 15/00* (2006.01)

(52) U.S. Cl. ..... 399/107; 399/110

(58) Field of Classification Search ..... 399/107, 399/110, 111; 347/152
See application file for complete search history.

(56) References Cited

U.S. PATENT DOCUMENTS

| | | | | |
|---|---|---|---|---|
| 3,992,557 A | | 11/1976 | Kubo et al. | |
| 4,569,582 A | | 2/1986 | Hyltoft | |
| 5,049,946 A | * | 9/1991 | Harada | 399/110 |
| 5,208,612 A | | 5/1993 | Obu et al. | |
| 5,379,101 A | * | 1/1995 | Takahashi et al. | 399/110 |
| 5,552,857 A | * | 9/1996 | Ishikawa | 347/152 X |
| 5,850,581 A | * | 12/1998 | Roller | 399/107 X |
| 5,881,340 A | * | 3/1999 | Stickney et al. | 399/110 |
| 5,950,046 A | * | 9/1999 | Goto | 399/110 |
| 5,953,559 A | * | 9/1999 | Obu | 399/110 |
| 6,259,872 B1 | * | 7/2001 | Fukunaga et al. | 399/107 |

FOREIGN PATENT DOCUMENTS

| | | |
|---|---|---|
| DE | 29 24 911 | 1/1980 |
| DE | 39 11 933 A1 | 10/1990 |
| DE | 43 33 383 C2 | 5/1998 |
| EP | 0 834 784 A1 | 4/1998 |
| EP | 0 896 256 A2 | 2/1999 |
| EP | 0 932 851 B1 | 8/1999 |
| JP | 2000 081827 | 3/2000 |
| WO | WO 98/43136 | 10/1998 |

* cited by examiner

*Primary Examiner*—Sandra L. Brase
(74) *Attorney, Agent, or Firm*—Pauley Petersen & Erickson

(57) ABSTRACT

An electrophotographic printing device of modular construction with a support device, including a transport device, upon which a substrate may be transported between a start position and a target position and one or several electrophotographic units arranged on the support device, between the start and target position, having a developer unit, a photoconductor and an illumination unit for the photoconductor. The support device includes two or more housing positions arranged one behind the other in the transport direction of the transport device, provided with unitary mechanical interfaces. The electrophotographic units include unitary fixing pieces which are complementary in form to the interfaces. Such a printing device may be flexibly laid out due to the technical assembly thereof and may be individually set-up easily for specific printing jobs.

24 Claims, 1 Drawing Sheet

ELECTROPHOTOGRAPHIC PRINTING DEVICE OF MODULAR CONSTRUCTION

BACKGROUND OF THE INVENTION

1. Field of the Invention

This invention relates to a modularly constructed electrophotographic printing device with a support device, having a transporting device on which a substrate to be imprinted can be conveyed between a start and a finish position, wherein several electrophotographic units can be arranged on the support device between the start and finish positions, which are embodied as a photo conductor, a developer unit, an exposure unit and the like.

2. Discussion of Related Art

A printing device of this type is known from European Patent Reference EP-B-0 932 851. With this known printing device, the units required for the printing process are arranged behind each other in a definite sequence, beginning at the start position in the direction toward the finish position. The units are designed for a particular printing program with defined individual processes, such as charging, character generation, developing, exposure, recharging and the like, and the transfer of the print image in the form of a toner image to a movable print carrier, which can also be a substrate which is moved on a further transport device occurs in the finish position. The transport device with the electrophotographic units is used only for receiving the toner image and for transporting the same into the transfer zone.

A known printing device requires considerable expenses in transport devices. Furthermore, the printing device cannot be adjusted to different printing processes, nor easily provided with further units, also in a different sequence, between the start and finish positions.

Further printing devices are known, which are designed for definite printing processes, or wherein the electrophotographic units themselves can be interconnected, as shown in U.S. Pat. No. 5,208,612. The structure of the printing device can also be provided without a connection to the transport device with lined-up units, as disclosed in U.S. Pat. No. 4,569,582 and Patent Abstracts of Japan, vol. 2000, no. 06, Sep. 22, 2002 and Japanese Patent Reference JP 200 08 1827 A (Canon Inc.) dated Mar. 21, 2002. A flexible and universal adaptation of the printing device to various printing processes is not possible there.

SUMMARY OF THE INVENTION

It is one object of this invention to provide a modularly constructed electrophotographic printing device, which can be simply adapted to various printing processes.

In accordance with this invention, the support device has several receivers, located one behind the other in the transporting direction of the transporting device, with uniform mechanical and electrical interfaces for attaching electrophotographic units, wherein these units have fastening elements equipped for the mechanical connection and, the same as the receivers, have a bus system for the electrical connection. If a sufficient number of receivers is provided, a different number of various units can also be required in different sequences for the printing process. The units can be placed into any receiver and mechanically and electrically connected with the receiver, and thus can be electrically connected with the central control unit. In this case the bus system provides for different connections to the control unit, depending on the unit employed. Great flexibility and variation options for different printing processes are provided by this design of the printing device, which is solely provided by the number of units, the occupied receivers and the sequence of the units between the start and finish positions.

In one embodiment of this invention, the support device is assembled from at least two partial frames placed one behind the other, and the partial frames are structurally identical and each has at least one receiving position for an electrophotographic unit. Thus, it is possible to construct the support device so that it is adapted to individual requirements in the desired way. The number of electrophotographic units to be employed will mainly determine the number of partial frames.

It is also possible to provide the transporting device as a uniform component conducted over all partial frames, or so that each partial frame has its own partial transporting device. The individual partial transporting devices can be coupled with each other mechanically and/or by an electrical drive control for forming a uniform transporting device. The connection of the partial transporting devices assures synchronous feeding, so that the substrate can be transported at a steady speed.

To assure an orderly supply of substrates, a centering module can be installed on the support device in the area of the start position. Thus, the centering module also represents a uniform component which can be connected with the printing device as a kit.

A pre-centering module can be connected upstream of the centering module in the transporting direction, and the pre-centering module can be installed on the support device or the centering module. Together with the centering module, the pre-centering module assures an exact alignment of the substrate and its orderly feeding.

In one embodiment of this invention, a fixation module is arranged on the support device or on the electrophotographic unit, which is used for pre-fixation or fixation of the toner applied to the substrate. After the toner has been applied by one or more of the electrophotographic units, the toner can be bonded to the surface of the substrate by the fixation module with a suitable energy application. Pre-fixation of the toner following the completed toner application is practical in case ceramic colors, for example, are to be printed. Usually these ceramic colors are applied to substrates made of glass or of a glass-ceramic material. After leaving the printing device, the substrate with the pre-fixated toner is taken to a unit for final fixation, in which the toner is fixated at a high temperature, and with ceramic toners is burned in, or in case of pressure-setting plastic material is cured.

The fixation module can have fastening elements, by which it can be connected to the interfaces of the support device. Therefore the interfaces are not only used for fastening and the exact alignment of the electrophotographic units, but also the fixation module or modules.

As mentioned above, a single fixation module can be provided for a printing device. This would usually be arranged downstream in the transport direction following the individual electrophotographic units. However, it is also possible for a fixation module to be assigned to each one of the electrophotographic units, so that intermediate fixations become possible. This can be important in particular in cases where toners are intended to be printed on top of each other, for example.

A delivery module can be provided in the area of the finish position. It is possible with the latter to achieve orderly removal of the imprinted substrates. The delivery module can be a stacking device, for example, installed on the support device.

So that it is possible to dependably imprint flat substrates of large wall thickness in particular, for example glass plates, plates of glass-ceramic material, wood panels or plastic panels, in one embodiment of this invention, every electrophotographic unit has a transfer system for transferring the toner to the substrate, and a primary charger is connected upstream in the transport direction to the transfer system, and a secondary charger downstream in the transport direction. The surface of the substrate can be electrostatically charged by the primary and secondary chargers. Charging brushes, charging rollers or charging coronas are conceivable chargers which preferably act on the surface of the substrate to be imprinted. During its passage through the electrophotographic unit, the substrate is first charged by the primary charger. Thereafter the substrate reaches the area of the transfer system, where a toner transfer occurs.

Then the substrate is pushed ahead to the secondary charger, where it is recharged. Depending on the size of the substrate or its positioning on the transporting device, the substrate is connected either with the primary charger, as well as the secondary charger, or only with the secondary charger. During the coating process the substrate is always in contact with at least one charger and is charged by it.

For example, four electrophotographic units can be installed on the support device for forming a full color printing system, in which colored toners, namely cyan-, magenta-, yellow- or black-colored toner is stored. The individual colors can be imprinted on top of each other, if required with intermediate fixation, or imprinted next to each other and mixed with each other. In this color further colors can be created in a known manner.

BRIEF DESCRIPTION OF THE DRAWINGS

This invention is explained in view of exemplary embodiments represented in the drawings, wherein.

DESCRIPTION OF PREFERRED EMBODIMENTS

Figure 1:
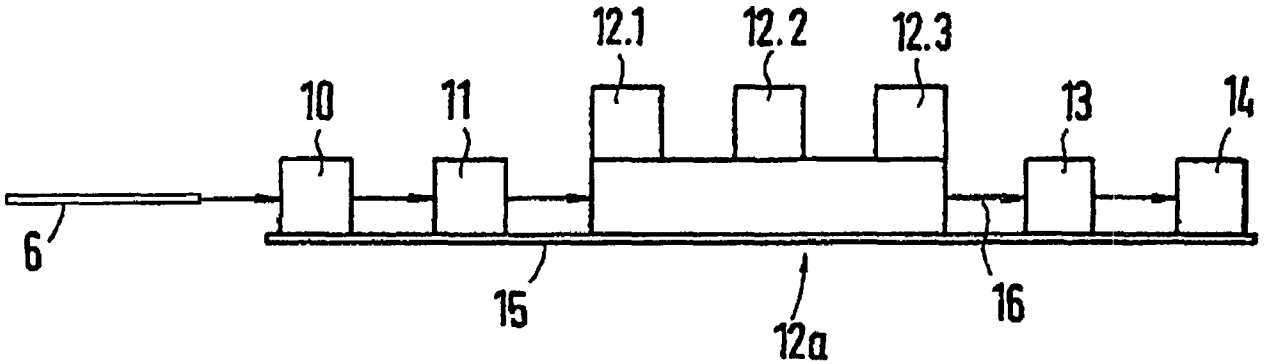
FIG. 1 is a printing device with an electrophotographic unit in a schematic view.

A printing device for imprinting plate-shaped materials is represented in FIG. 1. One-color printing can be performed with this printing device.

The printing device has a support device 15, to which a transport system 16 is assigned. Various components are arranged along the transport system. A substrate 6 can be transported between a start and a finish position by the transport system. The substrate 6 can be, for example, a glass plate, a plate of glass-ceramic material, a ceramic plate or a plastic panel. Flexible substrates, such as plastic foils, leather, textiles, etc. are printed, which during the printing process then are fixed in place on a rigid backing which is located on or in a part of the transporting device. A pre-centering module 10 is arranged in the area of the start position. The substrate is thus roughly positioned. Subsequently, with the transporting device 16 the substrate is fed to a centering module 11, in which it is exactly aligned. After completion of the positional alignment of the substrate, the substrate is fed to an electrophotographic unit 12*a*.

The electrophotographic unit 12*a* has a developer, a photo conductor and a transfer system 12.2. The electrophotographic unit 12*a* also has an exposure arrangement, by which a latent charge image can be created on the photo conductor in a known manner. Based on this charge image, a toner material, stored in a separate toner cartridge of the developer, is transferred to the photo conductor by the developer. Then the photo conductor transfers the toner to the substrate directly, or using the transfer system 12.2. In order to assure a toner transfer of good quality to the substrate, a primary charger or charge means 12.1 is installed upstream of the transfer system 12.2, and a secondary charger or charge means 12.3 is installed downstream. The primary and secondary charge means 12.1, 12.3 apply a charge to the surface of the substrate to be imprinted. This is maintained during the entire coating process by the arrangement of a primary charge means 12.1 and a secondary charge means 12.3.

At the completion of the toner application to the substrate, the substrate passes through a fixation module 13. In the fixation module 13 the toner is bonded with the substrate by temperature effects. Thereafter the substrate reaches a delivery module 14, in which it is removed from the printing device, enters a stacking device, for example a buffer, or reaches further processing stations via an appropriate linkage.

The support device 15 is embodied so that it has uniform mechanical interfaces for the electrophotographic unit 12*a*, as well as for the fixation module 13. Accordingly, the electrophotographic unit 12*a* and the fixation module 13 have fastening elements, which are embodied in a manner matching the mechanical and electrical interfaces of the support device. A rapid and simple assignment of these components to the support device 15 is thus possible.

Figure 2:
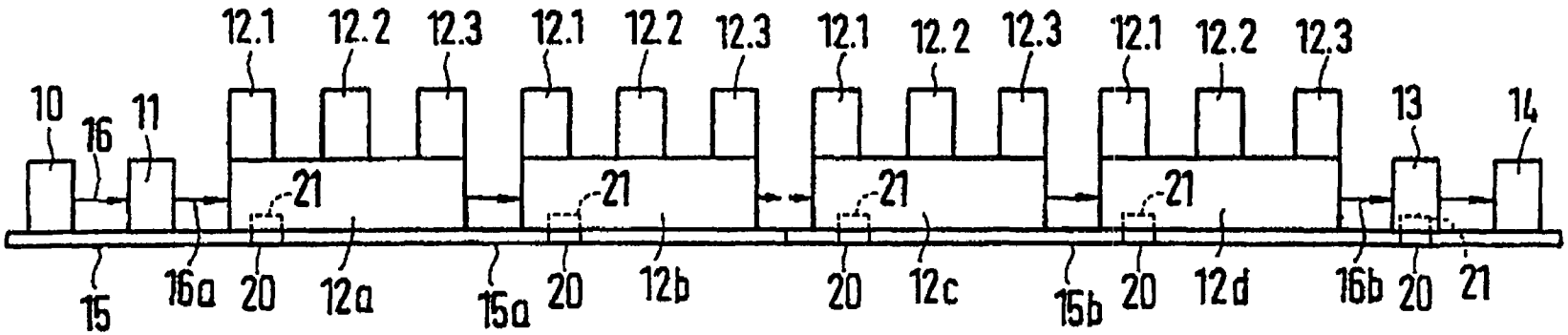
FIG. 2 is a full color printing system in a schematic view.

A full color printing system is shown in FIG. 2. Similar to the embodiment in accordance with FIG. 1, a support device 15 with a transport system 16 is used. In the embodiment shown in FIG. 2, the support device 15 is assembled from two partial frames 15*a*, 15*b* placed one behind the other. Each partial frame 15*a*, 15*b* has its own partial transporting device 16*a*, 16*b*. The support device 15 has five mechanical and electrical interfaces 20 located one behind the other, to which an electrophotographic unit 12*a*, 12*b*, 12*c*, 12*d*, or a fixation module 13, can be fastened by fastening elements 21. Because the mechanical and electrical interfaces are uniform, the electrophotographic units 12*a* to 12*d* can be arranged in any desired sequence. A toner is stored in each of the electrophotographic units 12*a* to 12*d*.

However, the toners are differently colored, for example a magenta-colored toner can be stored in the first electrophotographic unit 12*a*, a yellow toner can be stored in the electrophotographic unit 12*b*, in the electrophotographic unit 12*c* a cyan-colored toner can be stored, and in the electrophotographic unit 12*d* black toner can be stored.

As shown in FIG. 2, similar to FIG. 1 a pre-centering module 10, a centering module 11, a fixation module 13 and a delivery module 14 are mounted on the support device 15. A transport system 16 is also used, which links the individual components of the printing device with each other.

The invention claimed is:

1. In a modularly constructed electrophotographic printing device having a support device (15) which has a transporting device (16) on which a substrate to be imprinted can be transported between a start position and a finish position, wherein a plurality of electrophotographic units (12*a* to 12*d*) can be attached to the support device (15) between the start position and the finish position, which are designed as a photo conductor, a developer unit, or an exposure unit, the improvement comprising:

the support device (15) having a plurality of receivers located one behind an other in a transport direction of the transporting device (16), each of the plurality of receivers including a uniform mechanical and electrical interface for attaching one of the electrophotographic units (12*a* to 12*d*) to the support device (15), wherein the electrophotographic units (12*a* to 12*d*) have fastening elements equipped for a mechanical connection and have a bus system for the electrical connection.

2. In the printing device in accordance with claim 1, wherein the support device (15) is assembled from at least two partial frames placed one behind the other, and the partial frames are structurally identical and each has at least one receiving position for one of the electrophotographic units.

3. In the printing device in accordance with claim 2, wherein one of the transporting device (16) is conducted as a uniform component over all partial frames, and each partial frame has a partial transporting device, and the individual partial transporting devices are coupled with each other at least one of mechanically and by an electrical drive control for forming the uniform transporting device (16).

4. In the printing device in accordance with claim 3, wherein a centering module (11) is installed on the support device (15) near the start position.

5. In the printing device in accordance with claim 4, wherein a fixation module (13) is arranged following each of the electrophotographic units (12*a* to *d*).

6. In the printing device in accordance with claim 2, wherein a pre-centering module (10) is connected upstream of the centering module (11) in the transporting direction, and the pre-centering module (10) is installed on one of the support device (15) and the centering module (11).

7. In the printing device in accordance with claim 6, wherein a fixation module (13) is arranged on one of the support device (15) and one of the electrophotographic units (12*a* to *d*) which is used to one of pre-fix and fix the toner applied to the substrate.

8. In the printing device in accordance with claim 7, wherein the fixation module (13) has fastening elements for connection to interfaces of the support device (15).

9. In the printing device in accordance with claim 6, wherein a fixation module (13) is arranged following each of the electrophotographic units (12*a* to *d*).

10. In the printing device in accordance with claim 9, wherein a delivery module (14) is attached to the support device (15) near the finish position.

11. In the printing device in accordance with claim 10, wherein a delivery module (14) linkable with a further processing device is arranged near the finish position.

12. In the printing device in accordance with claim 11, wherein each of the electrophotographic units has a transfer system (12.2) for transferring the toner to the substrate, and a primary charger (12.1) is connected upstream in the transport direction to the transfer system, and a secondary charger (12.3) is connected downstream in the transport direction.

13. In the printing device in accordance with claim 12, wherein four of the electrophotographic units (12*a* to *d*) are installed on the support device (15), wherein colored toners, including cyan, magenta, yellow or black colored toner is stored in the individual electrophotographic units.

14. In the printing device in accordance with claim 12, wherein the printing device imprints flat rigid substrates.

15. In the printing device in accordance with claim 1, wherein one of the transporting device (16) is conducted as a uniform component over all partial frames, and each partial frame has a partial transporting device, and the individual partial transporting devices are coupled with each other at least one of mechanically and by an electrical drive control for forming the uniform transporting device (16).

16. In the printing device in accordance with claim 1, wherein a centering module (11) is installed on the support device (15) near the start position.

17. In the printing device in accordance with claim 16, wherein a pre-centering module (10) is connected upstream of the centering module (11) in the transporting direction, and the pre-centering module (10) is installed on one of the support device (15) and the centering module (11).

18. In the printing device in accordance with claim 1, wherein a fixation module (13) is arranged on one of the support device (15) and one of the electrophotographic units (12*a* to *d*) which is used to one of pre-fix and fix the toner applied to the substrate.

19. In the printing device in accordance with claim 18, wherein the fixation module (13) has fastening elements for connection to interfaces of the support device (15).

20. In the printing device in accordance with claim 1, wherein a delivery module (14) is attached to the support device (15) near the finish position.

21. In the printing device in accordance with claim 1, wherein a delivery module (14) linkable with a further processing device is arranged near the finish position.

22. In the printing device in accordance with claim 1, wherein each of the electrophotographic units has a transfer system (12.2) for transferring the toner to the substrate, and a primary charger (12.1) is connected upstream in the transport direction to the transfer system, and a secondary charger (12.3) is connected downstream in the transport direction.

23. In the printing device in accordance with claim 1, wherein four of the electrophotographic units (12*a* to *d*) are installed on the support device (15), wherein colored toners, including cyan, magenta, yellow or black colored toner is stored in the individual electrophotographic units.

24. In a modularly constructed electrophotographic printing device having a support device (15) which has a transporting device (16) on which a substrate to be imprinted can be transported between a start position and a finish position, wherein a plurality of electrophotographic units (12*a* to 12*d*) can be attached to the support device (15) between the start position and the finish position, which are designed as a photo conductor, a developer unit, or an exposure unit, the improvement comprising:

the support device (15) having a plurality of receivers located one behind an other in a transport direction of the transporting device (16), each of the plurality of receivers including a uniform mechanical and electrical interface for attaching one of the electrophotographic units (12*a* to 12*d*) to the support device, wherein the electrophotographic units (12*a* to 12*d*) have fastening elements equipped for a mechanical connection and have a bus system for the electrical connection;

wherein the printing device imprints flat rigid substrates.

* * * * *